US006283005B1

(12) United States Patent
Yagla et al.

(10) Patent No.: US 6,283,005 B1
(45) Date of Patent: Sep. 4, 2001

(54) INTEGRAL SHIP-WEAPON MODULE

(75) Inventors: Jon J. Yagla, King George; Robert C. Keen, Fredericksburg, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/124,010

(22) Filed: Jul. 29, 1998

(51) Int. Cl.[7] ..... F41F 3/04
(52) U.S. Cl. ..... 89/1.816
(58) Field of Search ..... 89/1.815, 1.816, 89/1.817, 1.818

(56) References Cited

U.S. PATENT DOCUMENTS

| | | | | |
|---|---|---|---|---|
| 2,925,013 | | 2/1960 | Santora et al. | 89/1.7 |
| 2,956,478 | * | 10/1960 | Ream, Jr. et al. | 89/1.815 |
| 3,002,342 | | 10/1961 | Schatzki | 60/230 |
| 3,315,565 | * | 4/1967 | Nash | 89/1.816 |
| 3,357,305 | * | 12/1967 | Clutz et al. | 89/1.816 |
| 3,590,684 | * | 7/1971 | Gilbert | 89/34 |
| 3,710,677 | * | 1/1973 | Mayer | 89/1.816 |
| 4,040,334 | * | 8/1977 | Smethers, Jr. | 89/1.818 |
| 4,556,438 | * | 12/1985 | Hoffmeister et al. | 89/1.816 |
| 4,732,075 | * | 3/1988 | Hurd | 89/44.02 |
| 4,796,510 | | 1/1989 | Piesik | 89/1.816 |
| 4,934,241 | | 6/1990 | Piesik | 89/1.817 |
| 5,012,718 | | 5/1991 | Miller | 89/1.816 |
| 5,106,034 | | 4/1992 | Yagla | 244/3.24 |
| 5,149,906 | | 9/1992 | August | 89/1.81 |
| 5,194,688 | | 3/1993 | Piesik | 89/1.816 |
| 5,473,886 | | 12/1995 | Lebrun et al. | 60/230 |

FOREIGN PATENT DOCUMENTS

| | | | | |
|---|---|---|---|---|
| 316189 | | 11/1956 | (CH) . | |
| 174069 | * | 3/1986 | (EP) | 89/1.816 |
| 45 | * | 7/1877 | (DE) | 89/1.816 |

* cited by examiner

*Primary Examiner*—Stephen M. Johnson
(74) *Attorney, Agent, or Firm*—James B. Bechtel, Esq.; John P. McMahon, Esq.

(57) ABSTRACT

A modular launching system is disclosed that reduces the reinforcement needs of mating a launching system to a ship, while at the same time reduces stress concentration and foundation movements created by the modular launching system launching launchable devices.

9 Claims, 11 Drawing Sheets

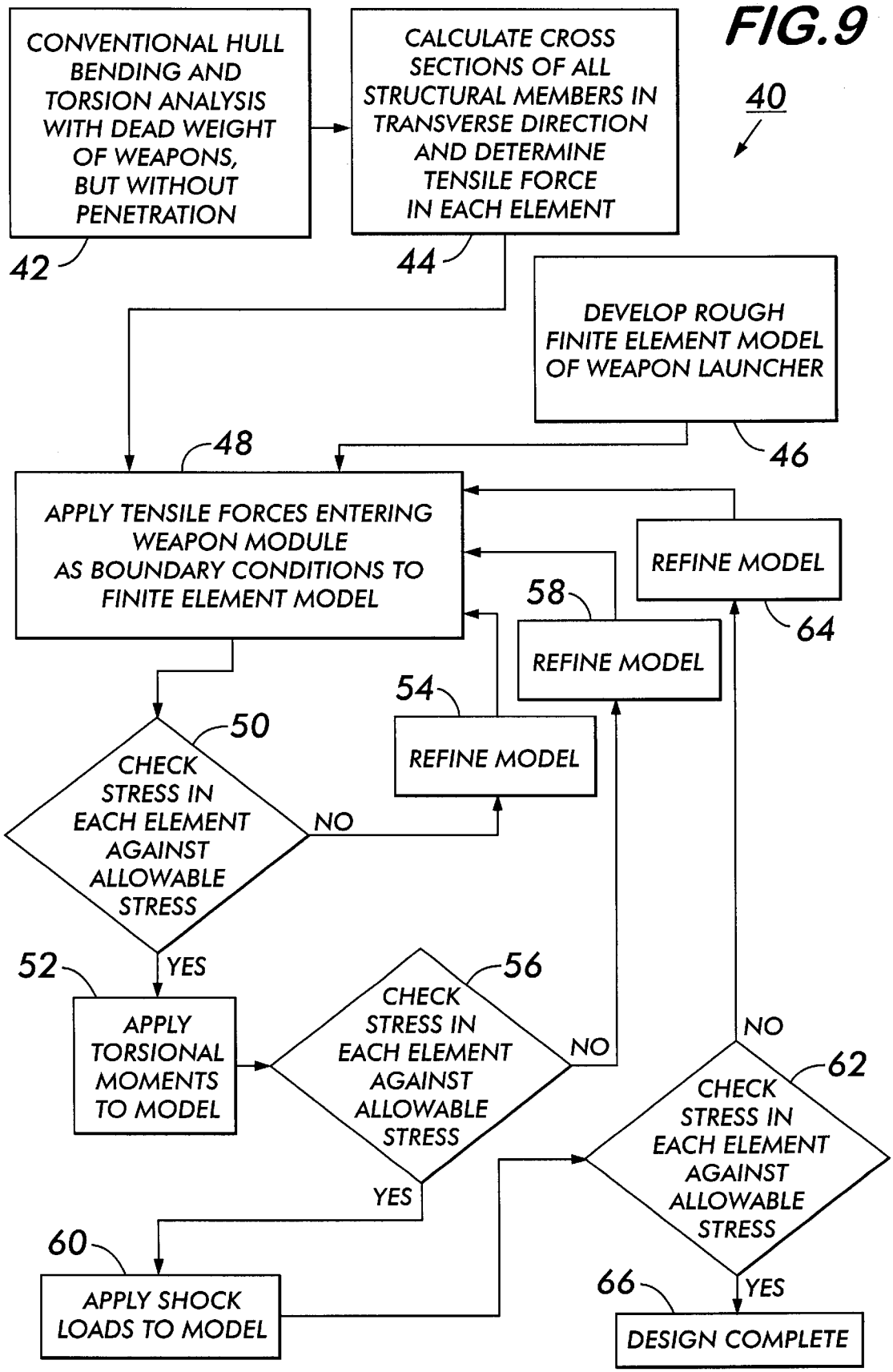
FIG.9
40
CONVENTIONAL HULL BENDING AND TORSION ANALYSIS WITH DEAD WEIGHT OF WEAPONS, BUT WITHOUT PENETRATION
42
CALCULATE CROSS SECTIONS OF ALL STRUCTURAL MEMBERS IN TRANSVERSE DIRECTION AND DETERMINE TENSILE FORCE IN EACH ELEMENT
44
DEVELOP ROUGH FINITE ELEMENT MODEL OF WEAPON LAUNCHER
46
48
APPLY TENSILE FORCES ENTERING WEAPON MODULE AS BOUNDARY CONDITIONS TO FINITE ELEMENT MODEL
REFINE MODEL
64
58
REFINE MODEL
54
REFINE MODEL
50
CHECK STRESS IN EACH ELEMENT AGAINST ALLOWABLE STRESS
NO
YES
52
APPLY TORSIONAL MOMENTS TO MODEL
56
CHECK STRESS IN EACH ELEMENT AGAINST ALLOWABLE STRESS
NO
YES
NO
62
CHECK STRESS IN EACH ELEMENT AGAINST ALLOWABLE STRESS
60
APPLY SHOCK LOADS TO MODEL
66
YES
DESIGN COMPLETE

INTEGRAL SHIP-WEAPON MODULE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1.0) Field of the Invention

The present invention relates to a modular launcher for launching missiles, torpedoes, sensors, or counter measures and, more particularly, to a modular launcher that reduces the reinforcement needs of a ship carrying the modular launcher while at the same time reduces the adverse affects commonly caused by the shock of the device being launched.

(2.0) Description of the Related Art

The primary types of missile launching systems consist of systems that are deck mounted and ones that are enclosed by the vessel, such as built-in launchers enclosed by the hull of the ship. The deck mounted launchers either stow the weapons ready to fire in the launcher, or stow the weapons in magazines below or beside the launcher. If the weapons are not stowed ready to fire, machinery is used to load the missiles into the launcher prior to use or to reload after firing. One such launching system fires the weapons from the magazine from within the ship. When the weapons are fired from within the ship, the exhaust gas from the rocket motor has to be conveyed out of the launcher space and discharged into the atmosphere. Exhaust gas management is an important aspect of designing this type of missile launcher. In one such launching system, the exhaust is captured in a plenum chamber under the missiles and then vented out of the plenum through an uptake (chimney). The uptake runs the width of the launcher and a large free area is required to avoid excessive pressure in the plenum and the uptake. Concentric canister launchers, such as those disclosed in U.S. patent application Ser. No. 08/772,054, now U.S. Pat. No. 5,837,919 and its continuation-in-part application U.S. patent application Ser. No. 09/070,770 and both of which are herein incorporated by reference, pass exhaust gas through an annular space between the cylinders and avoids excessive pressure in the plenum of the launching system.

For existing launching systems foundations are provided in the ship. In one such system, and for rotating arm launchers that load missiles from a magazine space below deck, a relatively large foundation needs to be provided and is located relatively low in the ship. One of the design requirements for launching systems is shock resistance and which has been a difficult design problem for all types of missile launching equipment. Relatively large missile launchers, with equipment foundations very low in the ship, have been especially difficult to design. This is because the shock motions created by underwater explosions are most severe in the keel of the ship. As one moves up and away from the keel, the elastic path associated with shock resistance becomes longer, and the shock advantageously becomes less intense.

With all types of weapons installations that penetrate the deck of a ship, great care has to be taken in the design parameters associated with the penetration. Although designing a penetration has to be one of the oldest problems in naval architecture and marine engineering, it still remains a relatively unsolved problem, especially for launching systems. Penetration parameters associated with warship hull-girder design uses the deck of the ship as a primary structural element that is to be penetrated and beam theory is used to design the deck of the ship. The deck of the ship is analogous to flange of an I-beam. When one penetrates or removes a portion of the deck to allow installation of a weapon, such as a launcher system, the bending strength of the deck is greatly compromised. Considerable reinforcement of the deck is required to recover the lost section modulus caused by the penetration. The larger the opening caused by the penetration, the more severe the requirement for reinforcement of the opening becomes, and the more difficult it becomes to maintain the flexural and torsional rigidity of the ship. Stress concentrations around the openings create additional challenges. For example, the mathematical theory of elasticity show that the stress concentration factor around a circular hole in a plate, such as that used for the deck of a ship, is three, i.e., the stress at the hole is three times the stress away from the hole. The size of the hole does not matter, but the shape has an impact. A square hole is much worse than a round hole. The perfectly square hole has theoretical stress concentration of infinity. Therefore, the openings that are basically rectangular, must use radiused corners to reduce stress concentration. Thus, the design problem associated with deck penetrations is two-fold, one must provide sufficient reinforcement to recover the lost section, and then the design must be further refined and detailed to minimize the stress concentrations. When all this is done considerable additional structural mass making up the reinforcements associated with deck penetrations results. When added to the weight of the weapon, there is a concentrated load in this part of the ship having the penetrated deck caused by the added launcher, which requires additional design effort, especially when shock loads drive the design process. It is desired to provide a solution that eliminates the bulky reinforcements of conventional penetrations into the deck of a ship, and to reduce stress concentration and foundation motions, both created by the launching of devices from a launching system.

OBJECTS OF THE INVENTION

It is a primary object of the present invention to provide a launcher that reduces the extent of the reinforcement to a ship that is necessary to accommodate the addition of a launching system.

Another object of the present invention is to provide a launching system that reduces stress concentrations and foundation motions created by the actual launching of devices from the launching system.

It is another object of the present invention to provide a launcher comprised of a material that is compensated for stress concentrations.

Furthermore, it is an object of the present invention to provide a launching system that is arranged so that it may be easily modified to adapt to the various parameters of different ships that carry different launchable devices.

SUMMARY OF THE INVENTION

The invention is directed to a modular launching system having concentric members that are arranged to mitigate reinforcement needs of structural members of ships carrying the launching system and to reduce the stresses and movements of the ship's members created by launching devices from the modular launching system.

The modular launching system comprises at least one column, at least one plate, at least one baffle and a plurality of collars. The at least one plate is joined to the column and has a plurality of spaced apart cylindrical openings. The at least one baffle is joined to the plate so as to separate the spaced apart cylindrical openings. The plurality of collars are dimensioned to fit into and be joined to the plurality of cylindrical openings.

BRIEF DESCRIPTION OF THE DRAWINGS

A better understanding of the present invention may be realized when considered in view of the following detailed description, taken in conjunction with the accompanying drawings.

FIG. 9 is a flow chart of the method of the present invention.

DETAILED DESCRIPTION OF PREFERRED EMBODIMENTS

Figure 1:
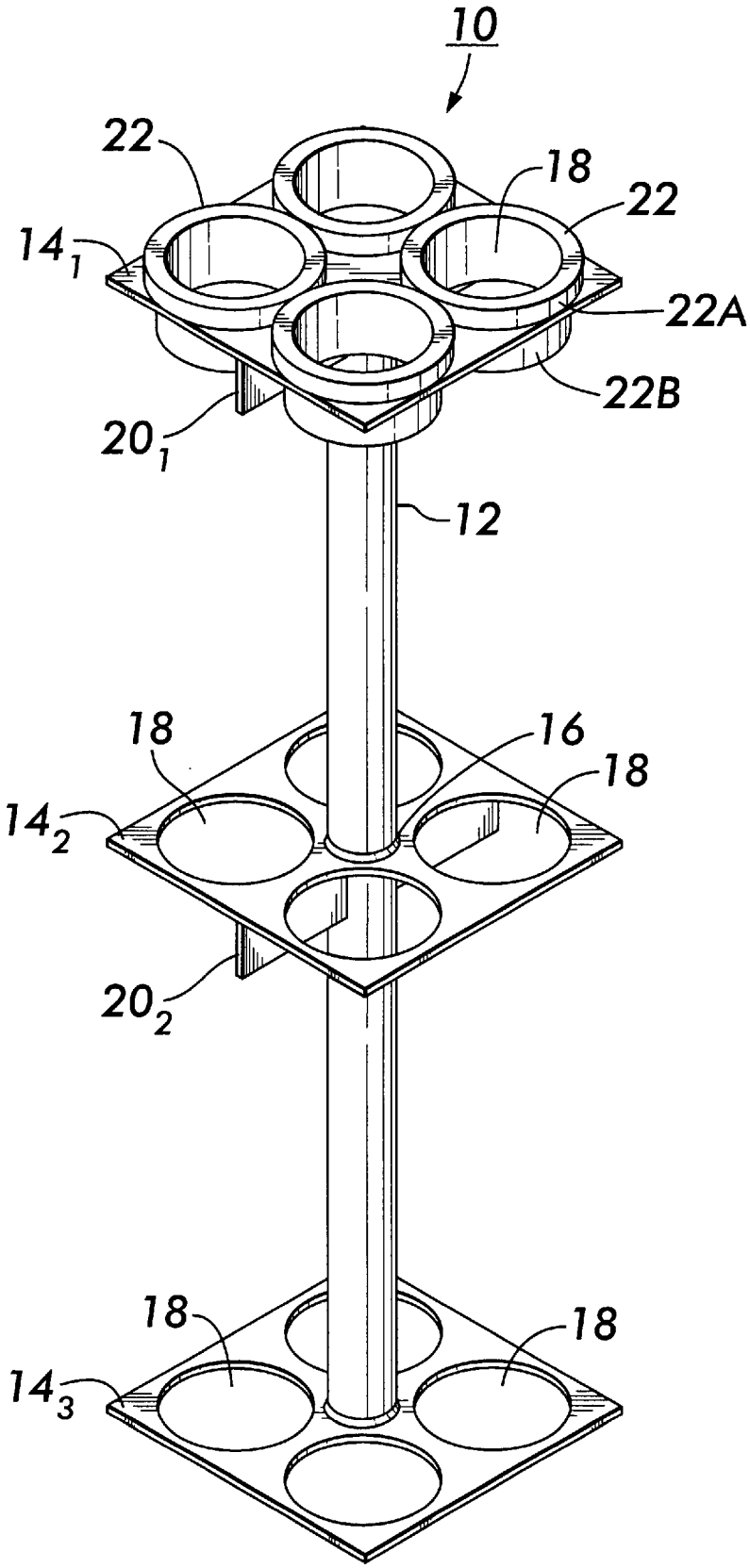
FIG. 1 illustrates a modular launcher of the present invention.

Referring to the drawings, wherein the same reference number identifies the same element throughout, there is shown in FIG. 1 a schematic of a modular launcher 10 comprising one embodiment of the present invention.

The modular launcher 10 comprises at least one column 12, and at least one plate, but preferably has three plates $\mathbf{14}_1$, $\mathbf{14}_2$ and $\mathbf{14}_3$ joined to the column 12 by appropriate means such as a weld 16. Each of the plates $\mathbf{14}_1$, $\mathbf{14}_2$ and $\mathbf{14}_3$ has a plurality of spaced apart cylindrical openings 18. The modular launcher 10 has at least one baffle, but preferably two baffles $\mathbf{20}_1$ and $\mathbf{20}_2$ respectively joined to the plates $\mathbf{14}_1$ and $\mathbf{14}_2$ so as to separate the spaced apart cylindrical openings 18 thereon. The modular launcher 10 has a plurality of collars 22 dimensioned to fit into and be joined to the plurality of cylindrical openings 18. Each of the collars 22 has an upper portion 22A and a lower portion 22B. The modular launcher 10 may be arranged into a matrix so as to provide the capabilities of launching multiple launchable devices such as missiles, torpedoes, sensors and countermeasures found aboard a ship and may be further described with reference to FIG. 2.

Figure 2:
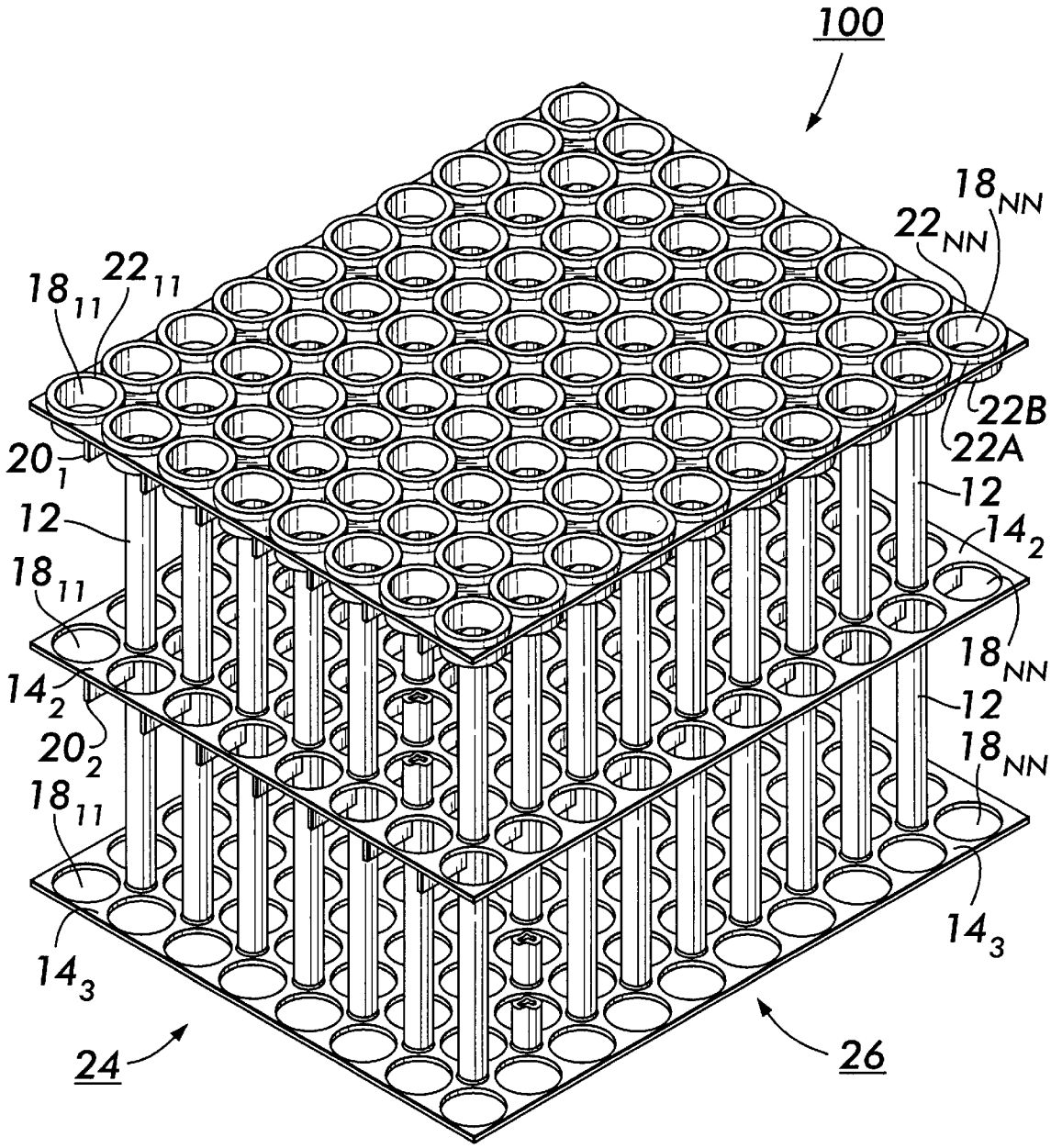
FIG. 2 is an isometric view of a plurality of modular launchers of FIG. 1 arranged into a row-column matrix forming one embodiment of a modular launching system of the present invention.

FIG. 2 is an isometric view of a modular launching system 100, wherein the modular launchers 10 of FIG. 1 comprising the plurality of cylindrical openings 18 and collars 22 are arranged into a matrix having row and column elements with the matrix being segmented into groups and with each group being defined by the elements of two rows and two columns of the matrix.

As seen in FIG. 2, the modular launching system 100 has a plurality of openings $\mathbf{18}_{11} \ldots \mathbf{18}_{NN}$ within each of the plates $\mathbf{14}_1$, $\mathbf{14}_2$ and $\mathbf{14}_3$ and a plurality of collars $\mathbf{22}_{11} \ldots \mathbf{22}_{NN}$ fitted into the opening $\mathbf{18}_{11} \ldots \mathbf{18}_{NN}$ of the plate $\mathbf{14}_1$.

As further seen in FIG. 2, and also FIG. 1, each of the columns 12 is associated with one group of openings $\mathbf{18}_{11} \ldots \mathbf{18}_{NN}$ and collars $\mathbf{22}_{11} \ldots \mathbf{22}_{NN}$. More particularly, one column 12 is preferably associated with four openings $\mathbf{18}_{11} \ldots \mathbf{18}_{NN}$ and four collars $\mathbf{22}_{11} \ldots \mathbf{22}_{NN}$. The arrangement of the modular launching system 100 may be further described with reference to FIG. 3 which is a top view thereof.

Figure 3:
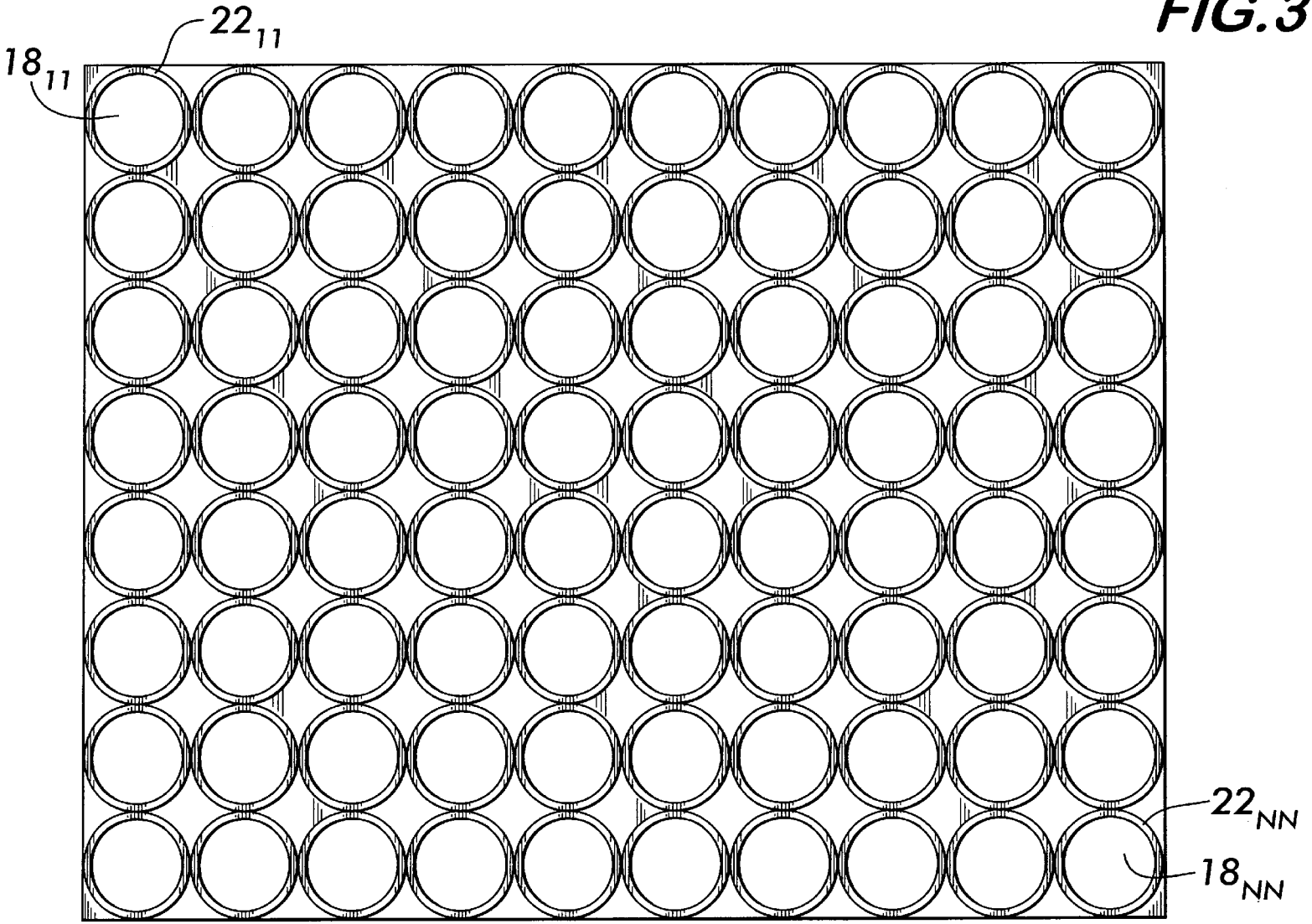
FIG. 3 is a top view of the modular launching system of FIG. 2.

As seen in FIG. 3, for one embodiment the modular launching system 100 may be arranged into an eight (8) row, ten (10) column matrix so as to support the launching of eighty (80) launchable devices. The modular launching system 100 has a long axis defined by the length spanned by the columns of the matrix. Each of the plates $\mathbf{14}_1$, $\mathbf{14}_2$ and $\mathbf{14}_3$ is joined to the column along the long axis. The modular launching system 100 may be further described with reference to FIG. 4 which is a side view, identified by the reference number 24 of FIG. 2.

Figure 4:
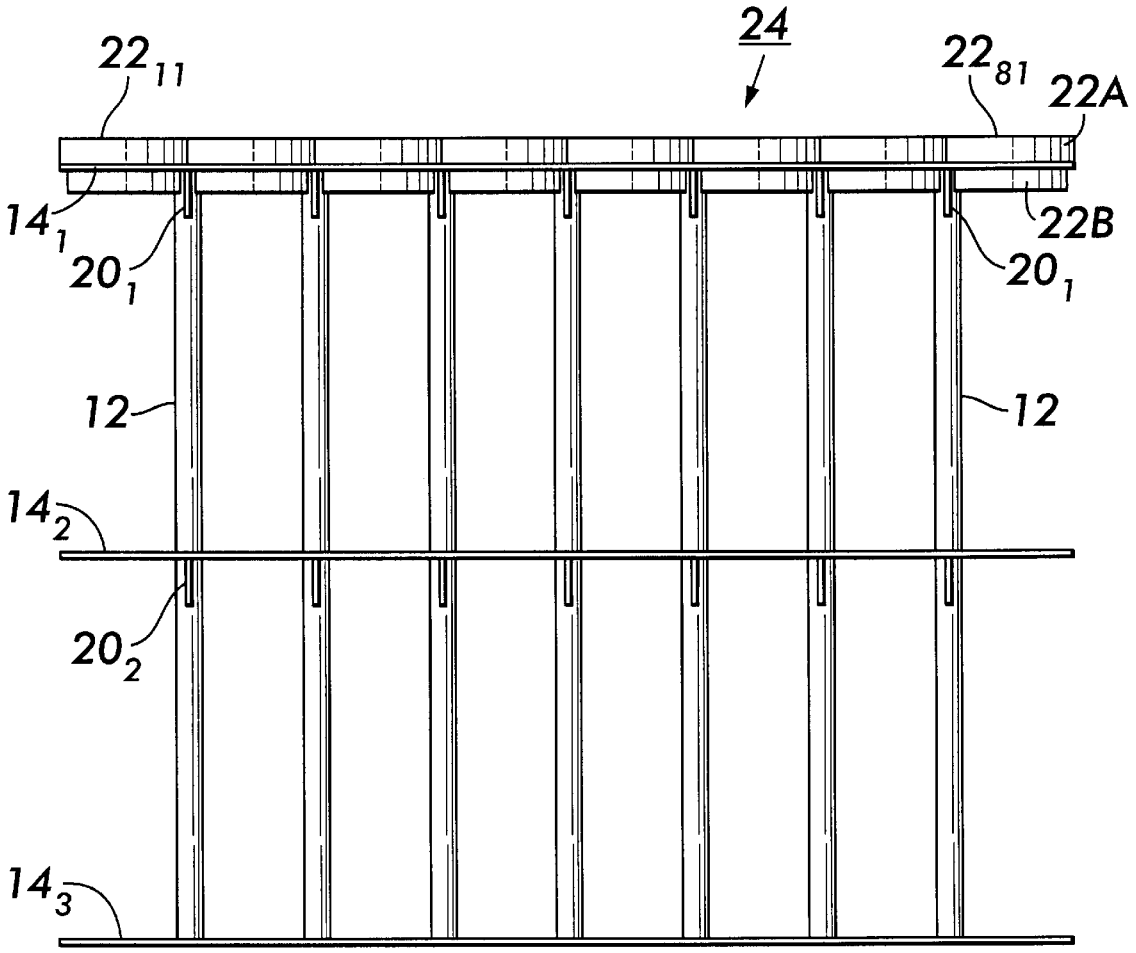
FIG. 4 is a front view of the modular launching system of FIG. 2.

As seen in FIG. 4, each of the plates $\mathbf{14}_1$, $\mathbf{14}_2$ and $\mathbf{14}_3$ are joined to each column 12. Each column 12 is preferably formed of a stainless steel type 316. Each column 12 has lower, intermediate, and upper portions and wherein, as seen in FIG. 4, the first ($\mathbf{14}_1$), second ($\mathbf{14}_2$) and third ($\mathbf{14}_3$) plates are respectively joined to the lower, intermediate and upper portions of each of the columns along the long axis of the modular launching system 100. The plates $\mathbf{14}_1$, $\mathbf{14}_2$ and $\mathbf{14}_3$ are preferably comprised of steel type A36.

The plates $\mathbf{14}_1$ and $\mathbf{14}_2$ each has baffles $\mathbf{20}_1$ and $\mathbf{20}_2$ separating the cylindrical openings 18 between the rows of the modular launching system 100. The baffles $\mathbf{20}_1$ and $\mathbf{20}_2$ may be further described with reference to FIG. 5 which is a front view, identified by the reference number 26 of FIG. 2.

Figure 5:
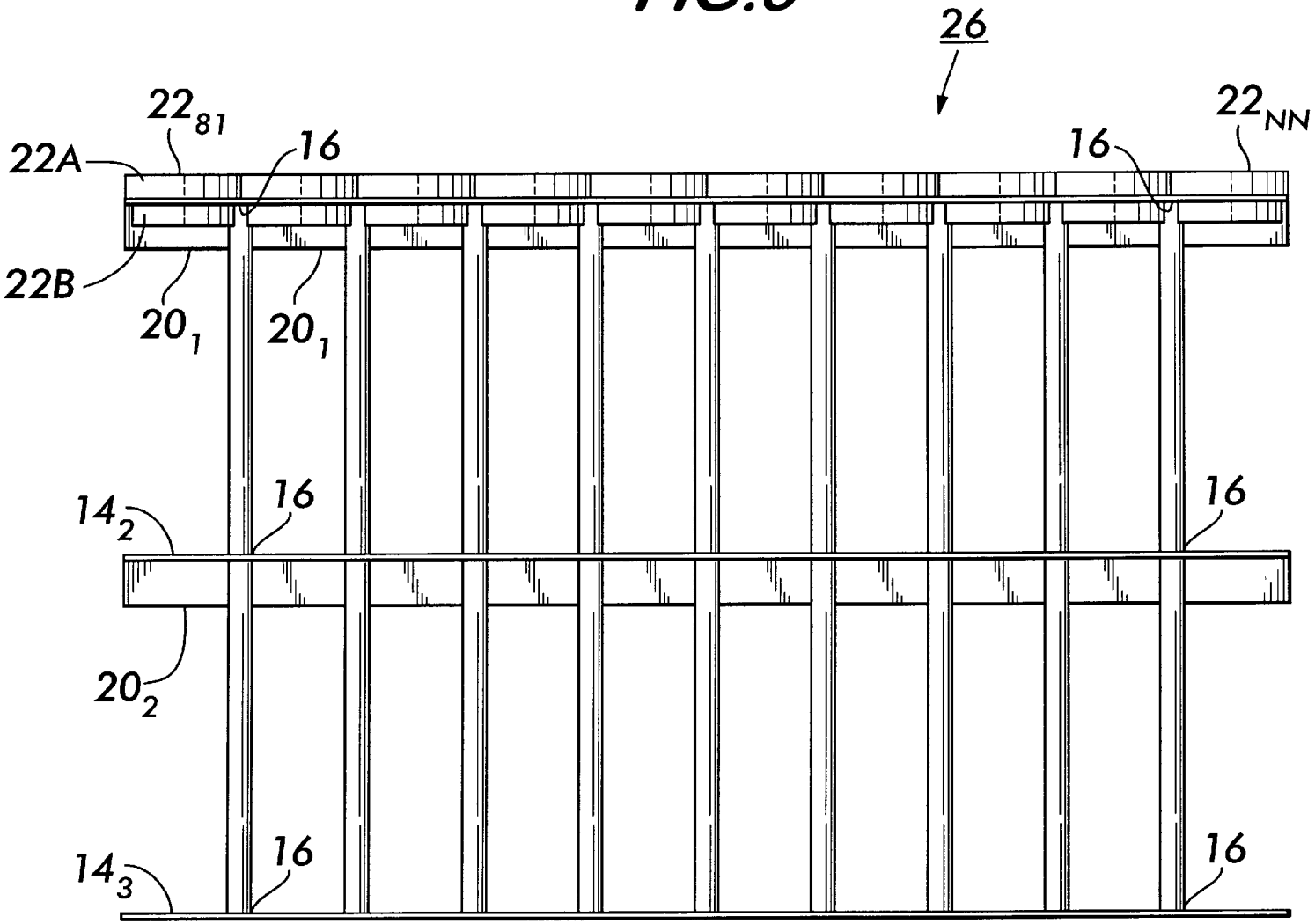
FIG. 5 is a side view of the modular launching system of FIG. 2.

As seen in FIG. 5, plates $\mathbf{14}_1$ and $\mathbf{14}_2$ have pluralities of baffles $\mathbf{20}_1$ and $\mathbf{20}_2$, respectively, that separate the opening $\mathbf{18}_{11} \ldots \mathbf{18}_{NN}$. As further seen in FIG. 5, the collars $\mathbf{22}_{81} \ldots \mathbf{22}_{NN}$, as well as all other collars $\mathbf{22}_{12} \ldots \mathbf{22}_{NN}$, are joined to the plate $\mathbf{14}_1$ and the baffles $\mathbf{20}_1$ separate adjacent collars $\mathbf{22}_{81} \ldots \mathbf{22}_{NN}$ each comprised of upper and lower portions 22A and 22B. Each of the collars $\mathbf{22}_{11} \ldots \mathbf{22}_{NN}$ is preferably comprised of malleable iron.

As will be further described with reference to FIG. 6, the modular launching system 100 makes use of round concentric canister launchers so as to allow a preferred or optimum shape to provide penetrations so as to minimize the needed reinforcement thereof. The modular launching system 100 allows the fiber stress in the deck of the ship to flow right on through the weapons module. No massive or global reinforcement is required. Should the shock motions need to be minimized, the weapons can be supported at deck level, rather than by foundations near the keel of the ship. This provides an advantageous long elastic path between the keel and the deck. If the weapons are in concentric canisters, the vertical shock loads at the weapons can be reacted at the base of the concentric launcher, advantageously providing additional elastic path so as to further minimize the shock motions created by the launching of launchable devices. If a "shock collar" approach, known in the art, to shock mitigation is used, the weapon reactions at the deck can be greatly reduced. A weapon, that is, a launchable device, lodged in a concentric canister which is beneficial to the present invention may be described with reference to FIG. 6.

Figure 6:
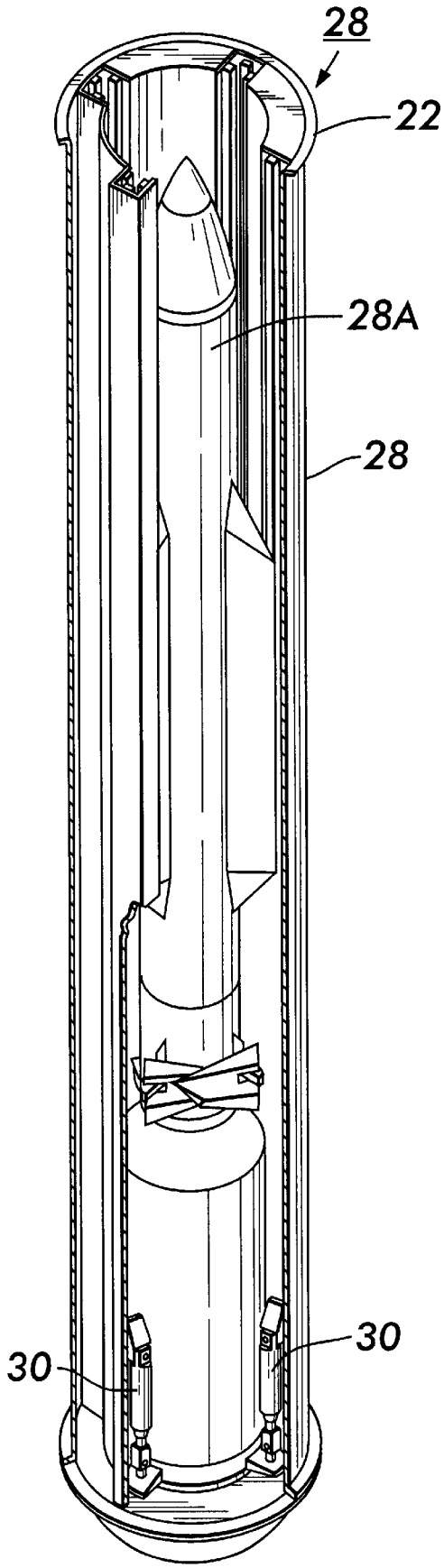
FIG. 6 illustrates a concentric launcher tube that may serve as one of the columns of the modular launching system of FIG. 2.

FIG. 6 illustrates a concentric canister 28 with liquid spring shock isolators 30 at its lower end and having confined therein a launcher device 28A. The outer casing of the concentric canister 28 may serve as one of the columns 12 of the modular launching system 100 of FIGS. 2–5.

With reference to FIGS. 2 and 4, it is seen that the plates $\mathbf{14}_1$, $\mathbf{14}_2$ and $\mathbf{14}_3$ are longitudinal plates running along the long axis of the modular launching system 100.

With reference to FIGS. 4 and 5 it is seen that the plates $\mathbf{14}_1$, $\mathbf{14}_2$ and $\mathbf{14}_3$ are vertical and run between the rows of the modular launching system 100. The long axis of the modular launching system 100 is aligned with the longitudinal axis (not shown) of the ship. The plates $\mathbf{14}_1$, $\mathbf{14}_2$ and $\mathbf{14}_3$ are interchangeably referred to herein as platform level deck plates.

With reference to FIGS. 2 and 5, it is seen that the columns 12 tie the platform level deck plates $\mathbf{14}_1$, $\mathbf{14}_2$ and $\mathbf{14}_3$ together to form a unit structure, that is, the modular launching system 100. If no bottom support, to be further described with reference to FIGS. 7 and 8, of the modular launching system 100 is required (or desired), the vertical component of shock motion created by the launching of a launchable device is reacted by the three deck plates $\mathbf{14}_1$, $\mathbf{14}_2$, and $\mathbf{14}_3$ and the columns 12. The weather deck level plate, that is, plate $\mathbf{14}_3$ is most critical, because it has to react to the shock load of all the missiles. The shock mitigation method, which includes the collars $\mathbf{22}_{11}$ . . . $\mathbf{22}_{NN}$, is therefore important to the design. Shock mitigation is required to reduce the shock input to the missiles, which usually cannot be expected to survive the shock motions of the ship unless they are protected. There are various means of shock mitigation, known in the art. The critical observation is that the same mitigation that reduces the shock load input to the missiles within the modular launching system 100 also reduces the reaction forces at the weather deck $\mathbf{14}_3$. If mitigation factors of say four (4) or five (5) can be attained by means known in the art, this is extremely beneficial to the design of the deck, as this is the main load the deck $\mathbf{14}_3$ must support during shock, and is by far the largest design load for the deck $\mathbf{14}_3$ in the vertical direction. Shock collars, known in the art, are best for this, because the shock collars mitigate the weight of both the missiles and the canisters within the modular launching system 100. Liquid spring shock isolators, such as those of FIG. 6, between the missile and the canister are second best because they mitigate the weight of the missiles. Some of the benefits of the present invention may be further described with reference to FIGS. 7 and 8.

Figure 7A:
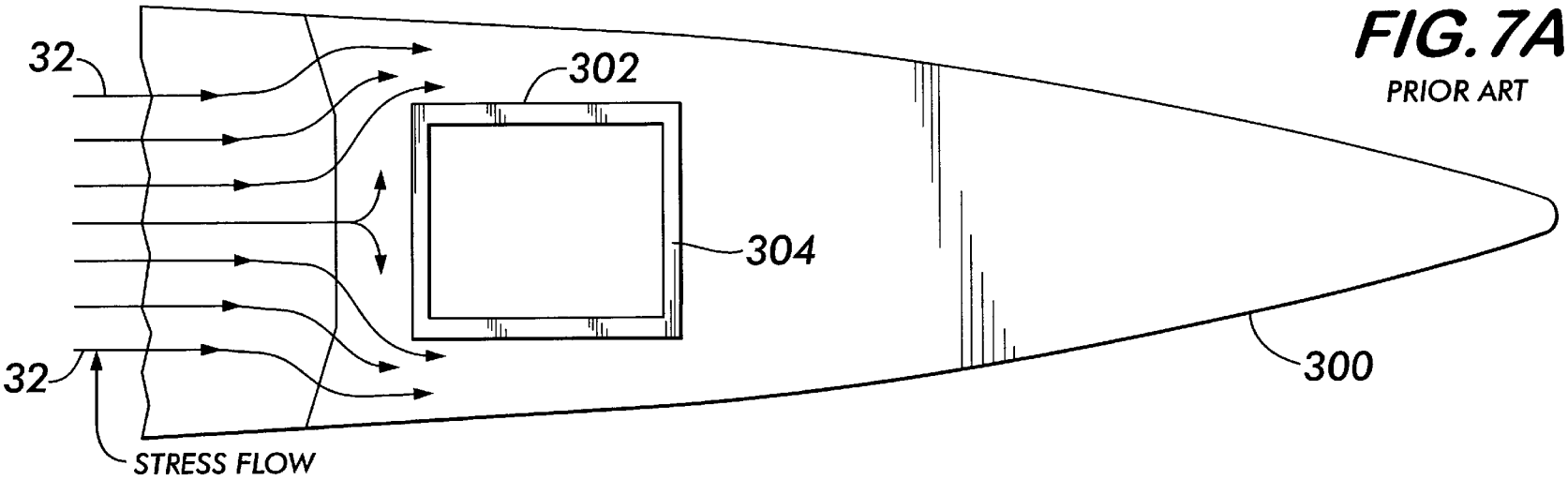
FIG. 7A PRIOR ART
FIG. 7 is composed of FIGS. 7(A) and 7(B) and illustrates a reinforcement arrangement of a prior art launching system.
Figure 7B:
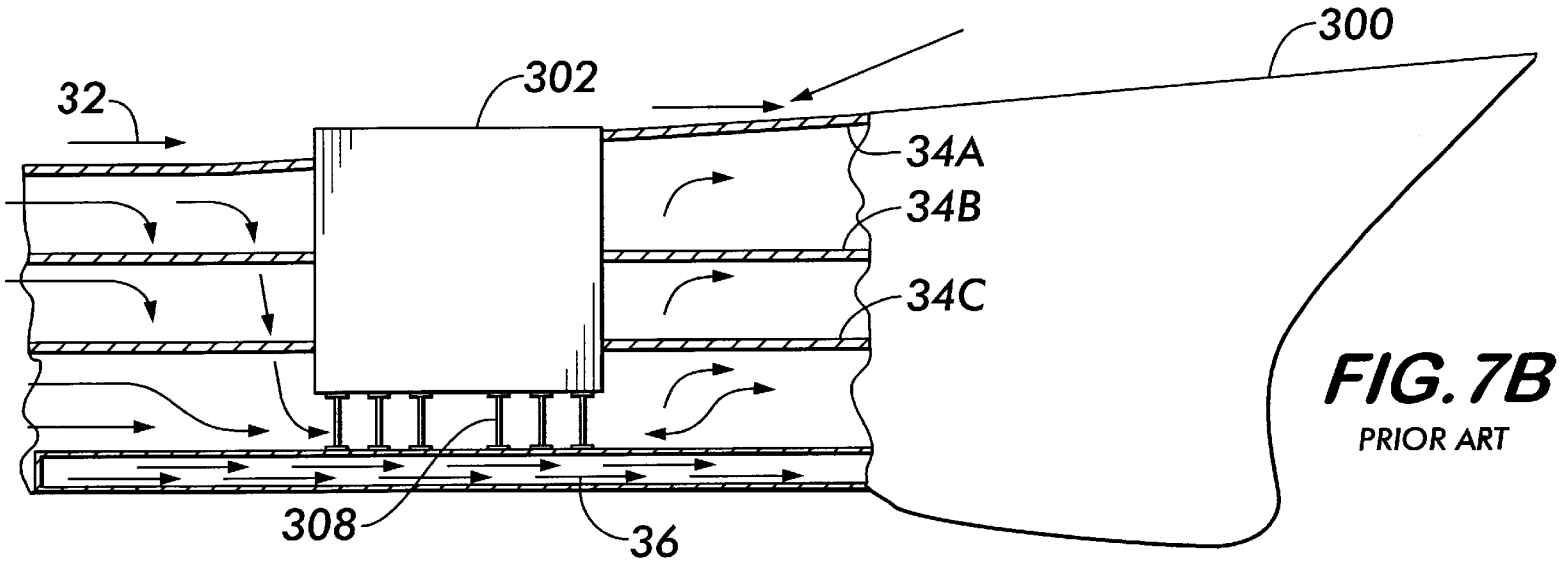
FIG. 7B PRIOR ART
Figure 8A:
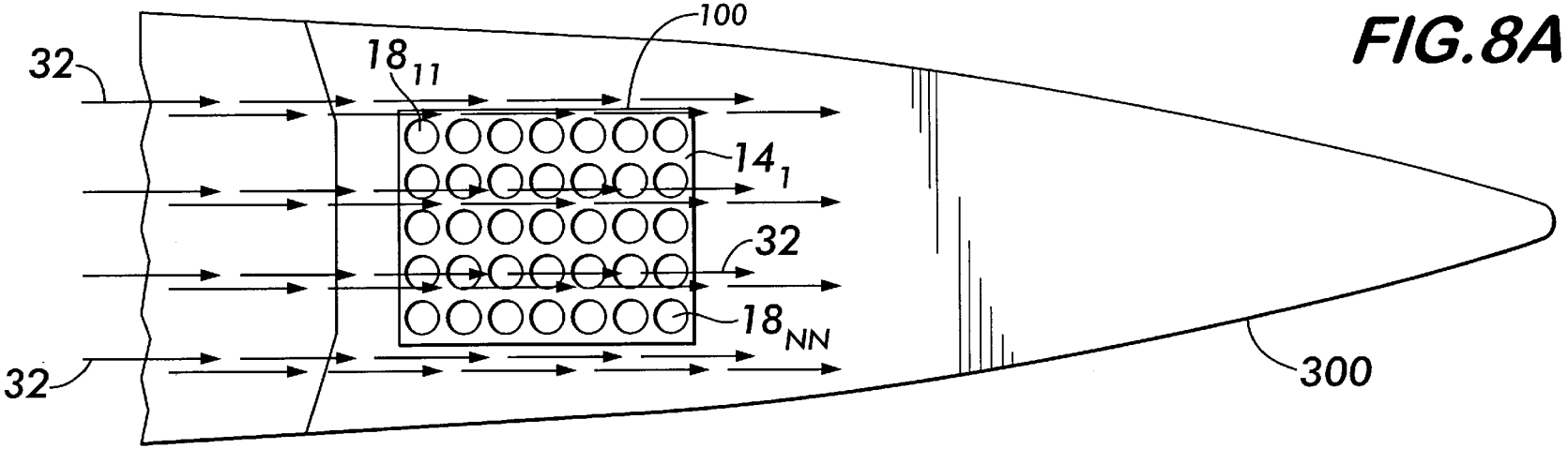
FIG. 8 is composed of FIGS. 8(A) and 8(B) and illustrates the reinforcement benefits of the launching system of the present invention.
Figure 8B:
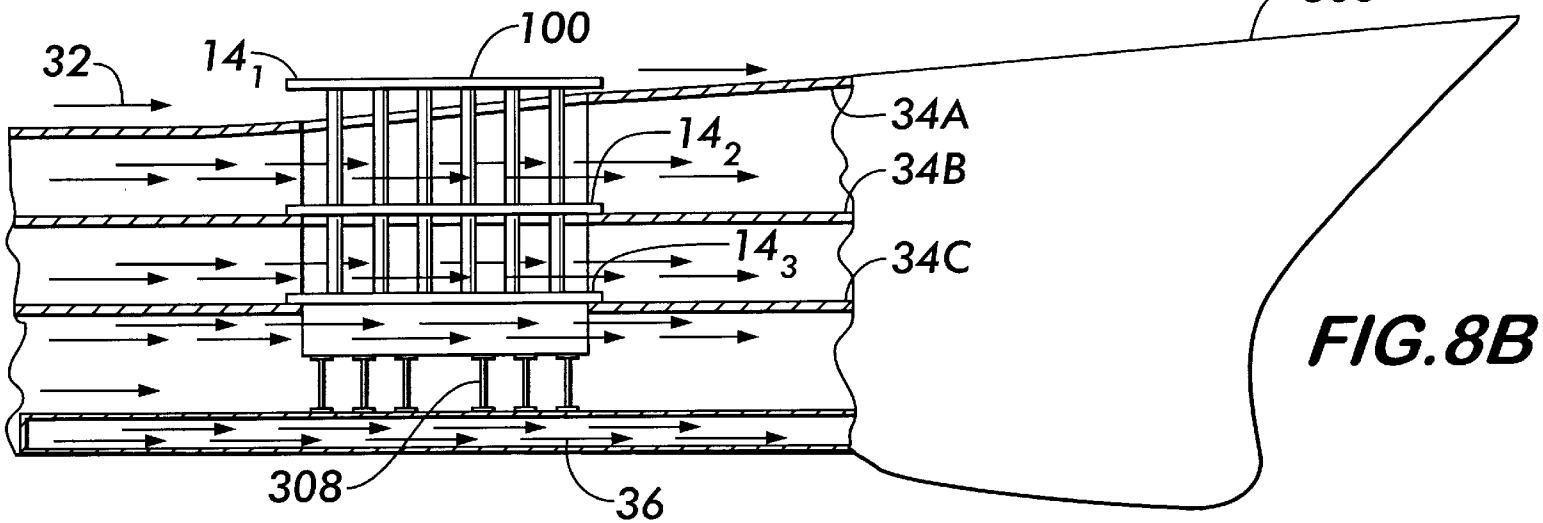

FIG. 7 is composed of FIGS. 7(A) and 7(B) and, similarly, FIG. 8 is composed of FIGS. 8(A) and 8(B), wherein both FIGS. 7 and 8 indicate stress flow by the use of directional arrows 32. FIG. 7 illustrates a situation wherein a launcher system is installed in a prior art manner and penetrates three typical decks 34A, 34B and 34C of a ship. FIG. 8 illustrates a situation wherein the modular launcher system 100 is installed and penetrates the same three decks 34A, 34B and 34C of a ship and at which the plates $\mathbf{14}_1$, $\mathbf{14}_2$ and $\mathbf{14}_3$ are in respective proximity thereto as shown in FIG. 8.

FIG. 7(A) shows a top view of a portion 300 of a ship wherein the prior art launching system is represented by a box 302 having rectangular perimeter 304 representing the reinforcement provisions, discussed in the "Background" section, necessary to compensate for the structure loss caused by the penetration of the launching system 302 into the decks 34A, 34B and 34C. From FIG. 7(A) it is seen that the stress flow 32 does not penetrate the launching system 302, but rather converges and becomes more intense so as to be able to pass around the launching system 302.

FIG. 7(B) shows a side view of the portion 300 of a ship wherein the prior art launching system 302 has a foundation 308 connected to the structure of the ship and generating shock waves indicated by directional arrows 36. The stress flow 32 indicated in FIG. 7(B) is similar to that of FIG. 7(A), that is, the stress flow 32 converges so as to flow under and does not flow through the launching system 302.

FIG. 8(A) shows a top view of the same portion of the ship of FIG. 7(A), that is, portion 300 and wherein the modular launching system 100 is inserted into and penetrates the same three decks of FIG. 7(B), that is, decks 34A, 34B and 34C. Unlike FIG. 7(A), FIG. 8(A) shows the stress flow 34 as advantageously flowing through the modular launching system 100.

FIG. 8(B) shows a side view of the portion 300 of a ship, wherein the modular launching system 100 has the same prior art foundation 308 as that of FIG. 7(B). However, unlike FIG. 7(B), the stress flow 32 flows through the modular launching system 100 and, more importantly, the stress flow 32 of FIG. 8(B) does not encounter any bending or converging rather it is relatively straight flow through the modular launching system 100.

As seen with reference to FIG. 8, the present invention eliminates the bulky reinforcements of a conventional penetration, that is, the present invention does not possess the reinforced perimeter 304 that would otherwise accompany the mounting of a prior art launching system into a ship. Further, the present invention reduces stress concentrations because of the relative straight stress flow 32 and also reduces severe foundation motions because the stress concentrations are small and localized. Further, shock loads commonly created by stress concentration are reduced by the practice of the present invention. Furthermore, if desired the structure of the modular launching system 100 may be formed by pre-stressed material so as to further compensate for the local stress concentrations which, in turn, has the secondary benefit, at no weight penalty, for advantageously reacting to the shock loads at a much high point in the ship. Moreover, the modular launching system 100 may be a fully stressed part of the receiving ship, rather than a plug-in item such as the launching system 302 of FIG. 7, that fits through a heavily reinforced penetration represented by perimeter 304 thereof.

In the practice of the present invention, the cross-section of plate $\mathbf{14}_1$ is the principal way in which the cross-section across the cylindrical opening $\mathbf{18}_{11}$ . . . $\mathbf{18}_{NN}$ is recovered so as to provide a continuous area moment of inertia about the ship's neutral axis for flexure. The design of the present invention is accomplished in a manner illustrated in FIG. 9 for the method 40 comprised of segments or steps given in Table 1.

TABLE 1

| SEGMENTS | GENERAL DESCRIPTION |
|---|---|
| 42 | CONVENTIONAL HULL BENDING AND TORSION ANALYSIS WITH DEAD WEIGHT OF WEAPONS, BUT WITHOUT PENETRATION |
| 44 | CALCULATE CROSS SECTIONS OF ALL STRUCTURAL MEMBERS IN TRANSVERSE |

TABLE 1-continued

| SEGMENTS | GENERAL DESCRIPTION |
|---|---|
| | DIRECTION AND DETERMINE TENSILE FORCE IN EACH ELEMENT |
| 46 | DEVELOP ROUGH FINITE ELEMENT MODEL OF WEAPON LAUNCHER |
| 48 | APPLY TENSILE FORCES ENTERING WEAPON MODULE AS BOUNDARY CONDITIONS TO FINITE ELEMENT MODEL |
| 50 | CHECK STRESS IN EACH ELEMENT AGAINST ALLOWABLE STRESS |
| 52 | APPLY TORSIONAL MOMENTS TO MODEL |
| 54 | REFINE MODEL |
| 56 | CHECK STRESS IN EACH ELEMENT AGAINST ALLOWABLE STRESS |
| 58 | REFINE MODEL |
| 60 | APPLY SHOCK LOADS TO MODEL |
| 62 | CHECK STRESS IN EACH ELEMENT AGAINST ALLOWABLE STRESS |
| 64 | REFINE MODEL |
| 66 | DESIGN COMPLETE |

In the determination of the needed cross-section of plate $\mathbf{14}_1$ one begins, as shown by segment 42 of FIG. 9, by calculating the cross-sectional area of the deck to which plate $\mathbf{14}_1$ is to be mated on either end of the modular launching system, assuming no penetration into the deck by the modular launching system 100. The deck is designed with an allowable stress, usually 18,000 psi. The allowable bending moment of this deck is then matched by selection of the plate $\mathbf{14}_1$ thickness and its thickness and depth of the longitudinal plates $\mathbf{14}_1$, $\mathbf{14}_2$ and $\mathbf{14}_3$ running between the rows of the modular launching system 100. These rough calculations are used as a starting point for a finite element analysis of the structure of the modular launching system 100. After the segment 42 of FIG. 9 is complete the method 40 sequences to segment 44. In conjunction with segment 44, segment 46 of developing a finite element model is accomplished.

Finite element analysis, such as performed in segment 46, is desired to calculate the needed thickness of plate $\mathbf{14}_1$ because the stress concentrations around the round openings cannot be analyzed with a handbook approach or strength of materials approach. After completion of segment 46, as well as segment 44, the method 40 sequences to segment 48.

Segment 48 sets up the boundary conditions for the finite element model being used for the weapon launcher 100 and, when complete, the method 40 sequences to element 50.

Segment 50 checks the stress in each element of the weapons launching system 100 is within allowable limits, and if YES, sequences to segment 52, but if NO, sequences to segment 54 which refines the finite element model originally of segment 46 and then sequences back to segment 48 for the continuation of the method 40.

Segment 52 applies torsional moments to the model and sequences to segment 56 which performs in a manner similar to that of segment 50, and if the stress in each element is allowable, segment 56 sequences to segment 60, but if the stress in each element is not allowable, segment 56 sequences to segment 58 which operates in a manner as already described for segment 54.

Segment 60 applies shock loads to the model and sequences to segment 62 which performs in a manner similar to segments 50 and 56, and if the stress in each element is allowable, segment 62 sequences to segment 66 and the design is complete, but if the stress in each element is not allowable, segment 62 sequences to segment 64 which operates in a manner as already described for segments 54 and 58.

In the practice of this invention, graphic techniques were used to illustrate the differences between the manner of installing a conventional launcher, such as that described with reference to FIG. 7, and that described with reference to FIG. 8 associated with modular launching system 100. The results of these differences are shown by a comparison between FIGS. 10 and 11.

Figure 10:
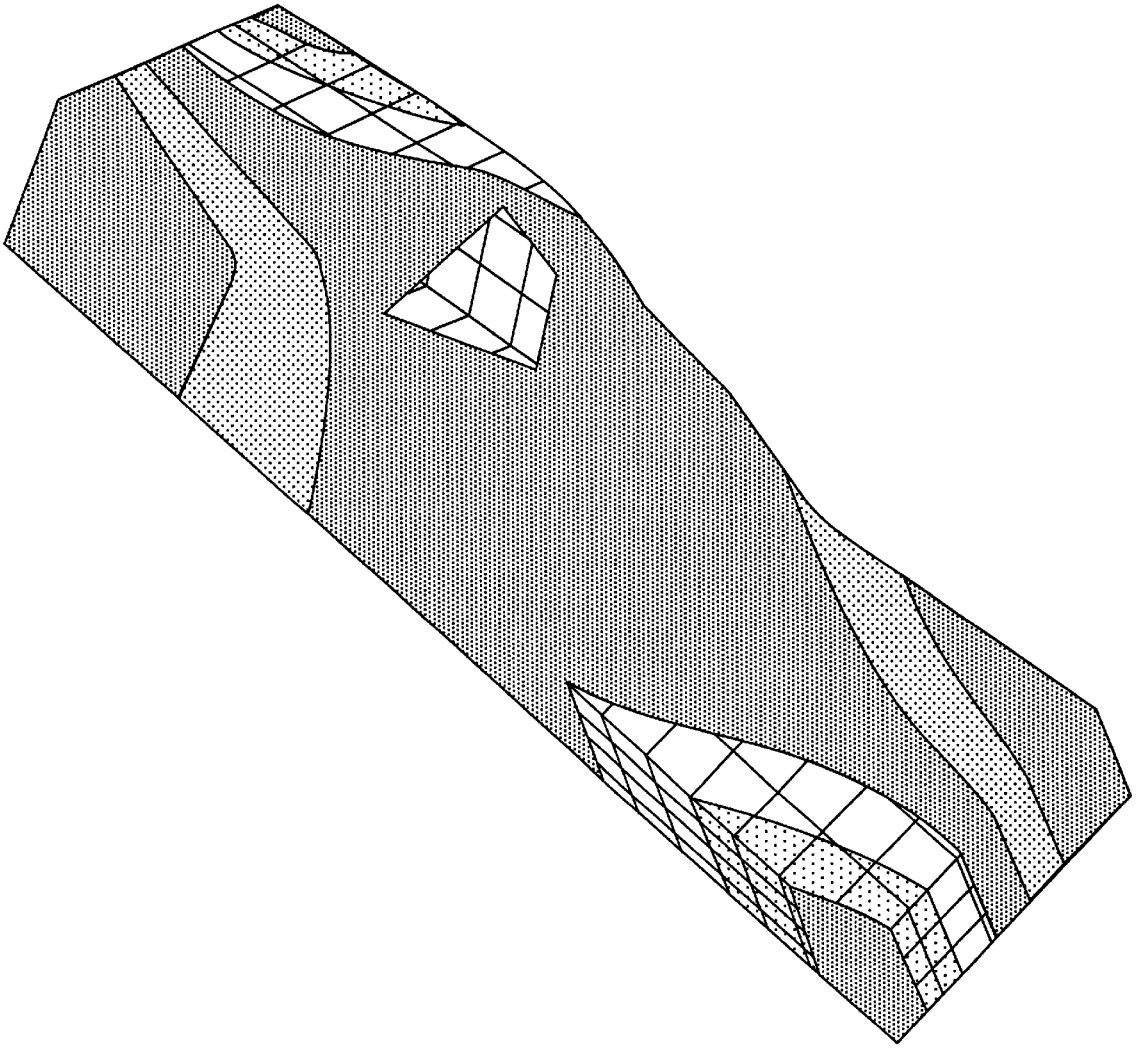
FIGS. 10 and 11 are graphic illustrations related to the installation of FIGS. 7 and 8 respectively.
Figure 11:
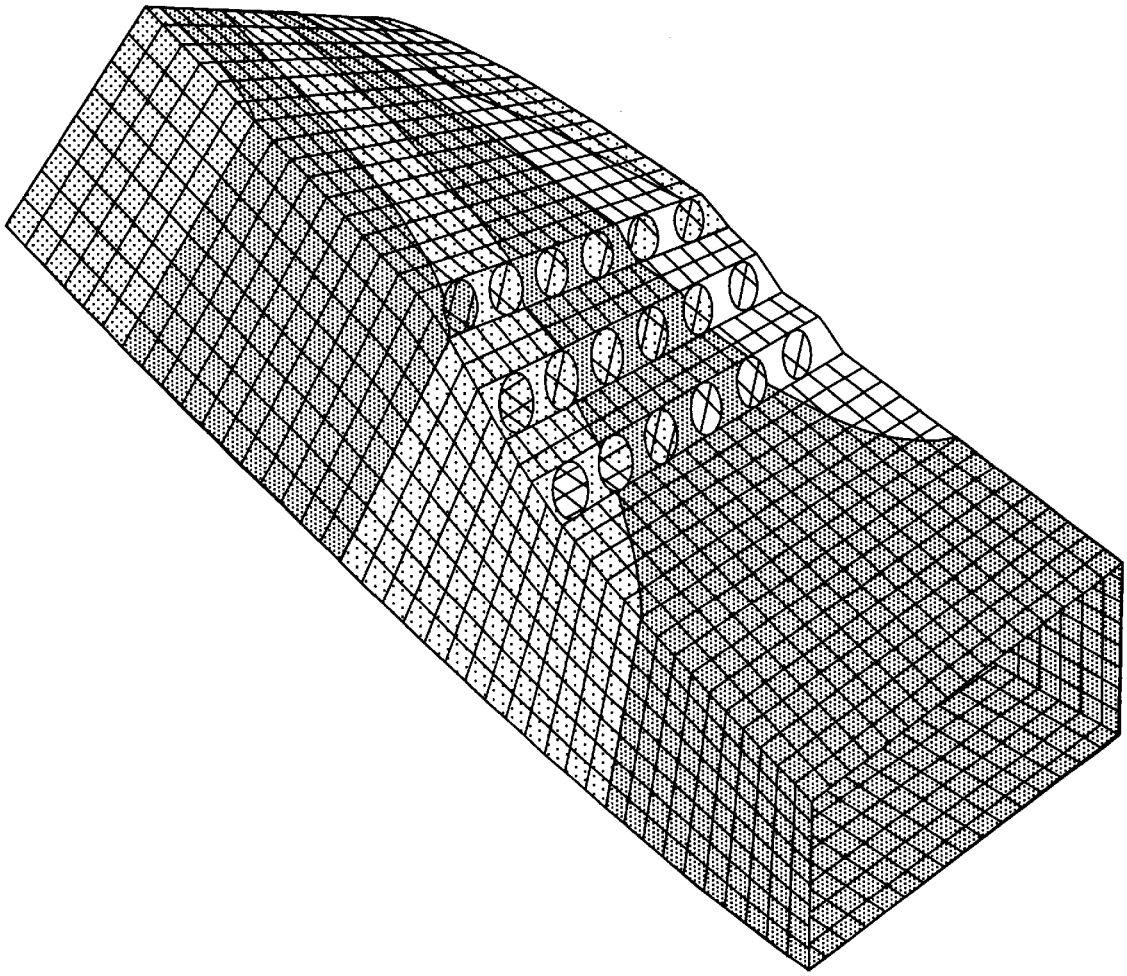

FIGS. 10 and 11 show a finite element model of vessels in 19 torsion. The vessels are identical except for the manner of installing the missiles. More particularly, the finite element model of FIG. 10 is associated with installing a launcher system accommodating missiles using the conventional practice, whereas FIG. 11 is a finite element model associated with installing the modular launching system 100 of the present invention accommodating missiles. The conventional reinforced penetration was designed to recover the flexural rigidity of the unpenetrated vessel. The conventional system represented by FIG. 10 is compared against the modular launching system 100 of FIG. 11 both of which meet the same criteria. The conventional penetration shows greater than twice the rotation under a unit torsion load as compared against the modular launching system 100. The weight of the reinforcement for the weapons installation for the modular launching system 100 was half that of the conventional reinforced penetration of the launcher 302 of FIG. 7.

It should now be appreciated that the modular launching systems of FIGS. 1 and 2 reduce the reinforcement needs of a ship carrying the modular launching system while at the same time reduce the adverse affects caused by the shock created by the launchable device being launched.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What we claim is:

1. A modular launcher comprising:

(a) at least one column;

(b) at least one plate directly joined to said column and having a plurality of spaced apart cylindrical openings;

(c) at least one baffle joined to said plate so as to separate said spaced apart cylindrical openings; and (d) a plurality of collars dimensioned to fit into and be joined to said plurality of cylindrical openings.

2. The modular launcher according to claim 1, wherein said plurality of cylindrical openings and collars are arranged into a matrix having row and column elements and the matrix being segmented into groups of row and column elements with each group being defined by the elements of two rows and two columns of said matrix.

3. The modular launcher according to claim 2, wherein said at least one column comprises a plurality of columns and with one column being joined to one group of row and column elements of said cylindrical openings and collars.

4. The modular launcher according to claim 3, wherein said plurality of columns has lower, intermediate, and upper portions and, wherein said at least one plate comprises first, second and third plates respectively joined to said lower, intermediate and upper portions of said plurality of columns.

5. The modular launcher according to claim 4, wherein said modular launcher has a long axis at which said first, second and third plates are joined therealong and wherein said at least one baffle comprises a plurality of baffles and with one baffle joined to said first, second, and third plates and separating the cylindrical openings and collars between rows of said matrix.

6. The modular launcher according to claim 5, wherein said plurality of collars are joined to said cylindrical openings of said third plate.

7. The modular launcher according to claim 1, wherein said plate is comprised of steel.

8. The modular launcher according to claim 1, wherein said column is comprised of stainless steel.

9. The modular launcher according to claim 1, wherein said collar is comprised of malleable iron.

* * * * *